US005941486A

United States Patent [19]

Riblet

[11] Patent Number: 5,941,486

[45] Date of Patent: Aug. 24, 1999

[54] BRACKET ASSEMBLY

[75] Inventor: Henry J. Riblet, Melvin Village, N.H.

[73] Assignee: Redev Management Corporation, Melvin Village, N.H.

[21] Appl. No.: 08/823,226

[22] Filed: Mar. 24, 1997

[51] Int. Cl.[6] ..... E04G 3/00

[52] U.S. Cl. ..... 248/219.4; 248/246; 248/248

[58] Field of Search ..... 248/219.4, 300, 248/248, 247, 240, 235, 240.3; 211/135, 193

[56] References Cited

U.S. PATENT DOCUMENTS

| | | | |
|---|---|---|---|
| 1,083,763 | 1/1914 | Smedberg | 248/248 |
| 1,224,016 | 4/1917 | Pertersen | 248/235 |
| 2,244,374 | 6/1941 | Riblet | 182/146 |
| 2,342,427 | 2/1944 | Riblet | 304/30 |
| 2,605,074 | 7/1952 | Bucsko et al. | 248/235 |
| 2,854,293 | 9/1958 | Riblet | 248/245 |
| 2,864,293 | 9/1958 | Riblet | 304/30 |
| 3,193,233 | 7/1965 | Wichser | 248/240.3 |
| 3,473,774 | 10/1969 | Riblet | 248/24 |
| 3,970,277 | 7/1976 | Riblet | 248/246 |
| 4,360,181 | 11/1982 | Burkholder | 248/248 |
| 4,452,336 | 6/1984 | Sickler | 182/82 |
| 5,257,766 | 11/1993 | Riblet | 248/248 |

*Primary Examiner*—Ramon O. Ramirez
*Assistant Examiner*—Anita M. King
*Attorney, Agent, or Firm*—Kriegsman & Kriegsman

[57] ABSTRACT

A bracket assembly includes an angle bracket formed from a single-piece metal blank which can be shaped and bent to define in its load-bearing form a substantially triangular bracket having vertical, diagonal and horizontal legs. Each of the legs have a pair of upstanding sidewalls which extend normally from an associated base to form a substantially U-shaped cross-section. The vertical and diagonal legs are contiguous and are connected by a first bendable section to define a first acute corner, the diagonal and horizontal legs are contiguous and are connected by a second bendable section to define a second acute corner and the vertical and horizontal legs are interconnected to define a third corner. The bracket assembly further includes a lower bracket arm captured at the first corner by at least one surface irregularity and a bolt captured at the second corner by at least one surface irregularity as the angle bracket is formed into its load-bearing shape.

28 Claims, 8 Drawing Sheets

BRACKET ASSEMBLY

BACKGROUND OF THE INVENTION

The present invention relates generally to bracket assemblies for heavy loads and more particularly to bracket assemblies which comprise a single piece angle bracket with means for attachment to another member. Angle brackets and bracket assemblies designed for heavy loads are well known in the art.

Angle brackets often comprise three main structural components, a horizontal, a diagonal and a vertical leg, which are interconnected so as to define, in load-bearing shape, a substantially triangular bracket. Bracket assemblies typically comprise an angle bracket of the type described above which is further attached to other members, such as an upper bracket arm and a lower bracket arm. An example of such a bracket assembly is disclosed in U.S. Pat. No. 2,342,427 to Riblet which is incorporated herein by reference. In U.S. Pat. No. 2,342,427, a lower bracket arm is shown attached to an angle bracket by a bolt which passes through a preformed hole in both the vertical leg and the diagonal leg.

In use, angle brackets and bracket assemblies are often mounted onto different surfaces to create various support structures.

For example, it is well known in the art to mount a pair of angle brackets directly onto a flat wall surface to create a shelf. A shelf is created by placing a horizontal plank across the pair of angle brackets. In this application, the vertical leg of each angle bracket is often provided with upper and lower keyslots or even the vertical leg may be replaced by the wall with out loss of strength. The keyslots can accommodate screws, nails or the like which extend through the angle bracket and into the wall surface to securely mount the angle bracket onto the wall surface.

It is also well known in the art to mount each of a pair of bracket assemblies onto an associated upright, such as a post or beam, to create a scaffold. A scaffold is created by securing the bracket arms of each bracket assembly onto its associated upright. A horizontal plank is then placed across the angle bracket of each bracket assembly to form the scaffold. In one application, each bracket assembly can be repositioned at varying heights along its associated upright to adjust the height of the scaffold.

In the art, angle brackets typically fall into two categories: one-piece angle brackets and multiple-piece angle brackets.

One-piece angle brackets include two or three legs which are formed from a single piece of material and which are interconnected so as to define a triangular bracket, the mounting surface being considered to be the third leg for one-piece angle brackets having two legs. For example, it is well known in the art for an angle bracket which can be used for shelving and other light loads to be formed entirely from a single sheet metal blank, one or more legs of the angle bracket being strengthened by longitudinal folding in the metal blank.

Multiple-piece angle brackets typically comprise two or three separate legs, as well as additional fastening components, which are interconnected so as to define a triangular bracket. U.S. Pat. No. 4,360,181 to Burkholder is a example of a multiple-piece angle bracket in which the vertical member of the angle bracket is a section of an extended upright. Multiple-piece angle brackets commonly comprise a plurality of structurally strong legs and a plurality of connecting means which may include nuts, bolts, rods and pins all interconnected to define, often with an additional vertical member, a triangular bracket. Due to the multitude of parts required, multiple piece angle brackets are more costly to manufacture and assemble than one-piece angle brackets.

Compared to one-piece angle brackets, however, it should be noted that the permissible strength of the parts included in multiple-piece angle brackets increase the overall strength of the angle bracket. In particular, it has been found that when compared with one-piece angle brackets, multiple piece angle brackets are considerably stronger at corners, each corner corresponding to the juncture of adjoining legs. As a consequence, multiple piece angle brackets are used for scaffolding and other heavy loads because they are capable of withstanding greater amounts of force than one-piece angle brackets.

In U.S. Pat. No. 5,257,766 to Riblet, which is incorporated herein by reference, there is disclosed an angle bracket constructed from a single piece metal blank. The bracket is of a substantially triangular shape. In one embodiment of the invention, the bracket has legs of U-shaped cross-section for strength. A method is disclosed for constructing the bracket from the metal blank which includes the steps of folding the metal blank along transverse fold lines to form its triangular shape. The method also includes the steps of folding the metal blank along longitudinal fold lines to form its U-shaped cross-section.

One-piece angle brackets, in which the bendable interconnections are strengthened by interlocking mechanical irregularities, tabs and slots for example, as described in U.S. Pat. No. 5,257,766 to Riblet, are extremely desirable since they combine the simplicity of the construction of one-piece angle brackets with the strength of the multiple-piece angle brackets. The simplicity of its construction results in substantial cost savings due to the need for less inventory control and greater ease in manufacture and assembly.

Angle brackets constitute the major component of bracket assemblies. Specifically, bracket assemblies comprise an angle bracket with additional parts attached to the corners of the angle bracket between the diagonal leg and the vertical and/or horizontal legs. In U.S. Pat. No. 2,854,293, a bracket assembly is disclosed in which a lower bracket arm is attached to the intersection between the diagonal and vertical legs of an angle bracket by a bolt. The bolt attaching the diagonal leg to the horizontal leg could also be used to attach an extension arm to the horizontal leg. Either or both of these arrangements are considered bracket assemblies.

SUMMARY OF THE INVENTION

It is an object of the present invention to provide a new and improved bracket assembly.

It is another object of the present invention to provide a bracket assembly of the type described above which comprises a one-piece angle bracket.

It is yet another object of the present invention to provide a bracket assembly of the type described above which comprises an angle bracket formed from a single piece metal blank.

It is still another object of the present invention to provide a bracket assembly of the type described above which is strong and is constructed to withstand high levels of force.

It is another object of the present invention to provide a bracket assembly of the type described above which is easy to manufacture, has a limited number of parts, and which is easy to use.

Accordingly, there is provided a bracket assembly comprising an angle bracket formed from a single-piece metal blank, shaped and bent to define, in its load-bearing form, a substantially triangular bracket having vertical, diagonal and horizontal legs, the vertical and diagonal legs being contiguous and connected by a first bendable section to define a first acute corner, the diagonal and horizontal legs being contiguous and connected by a second bendable section to define a second acute corner and vertical and horizontal legs being interconnected to define a third corner, and a first member coupled to said angle bracket, said first member being coupled to said angle bracket at one of said acute corners by at least one surface irregularity at said acute corner when the angle bracket is formed into its load-bearing shape.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings where like reference numerals represent like parts.

DETAILED DESCRIPTION OF A PREFERRED EMBODIMENT

Figure 1:
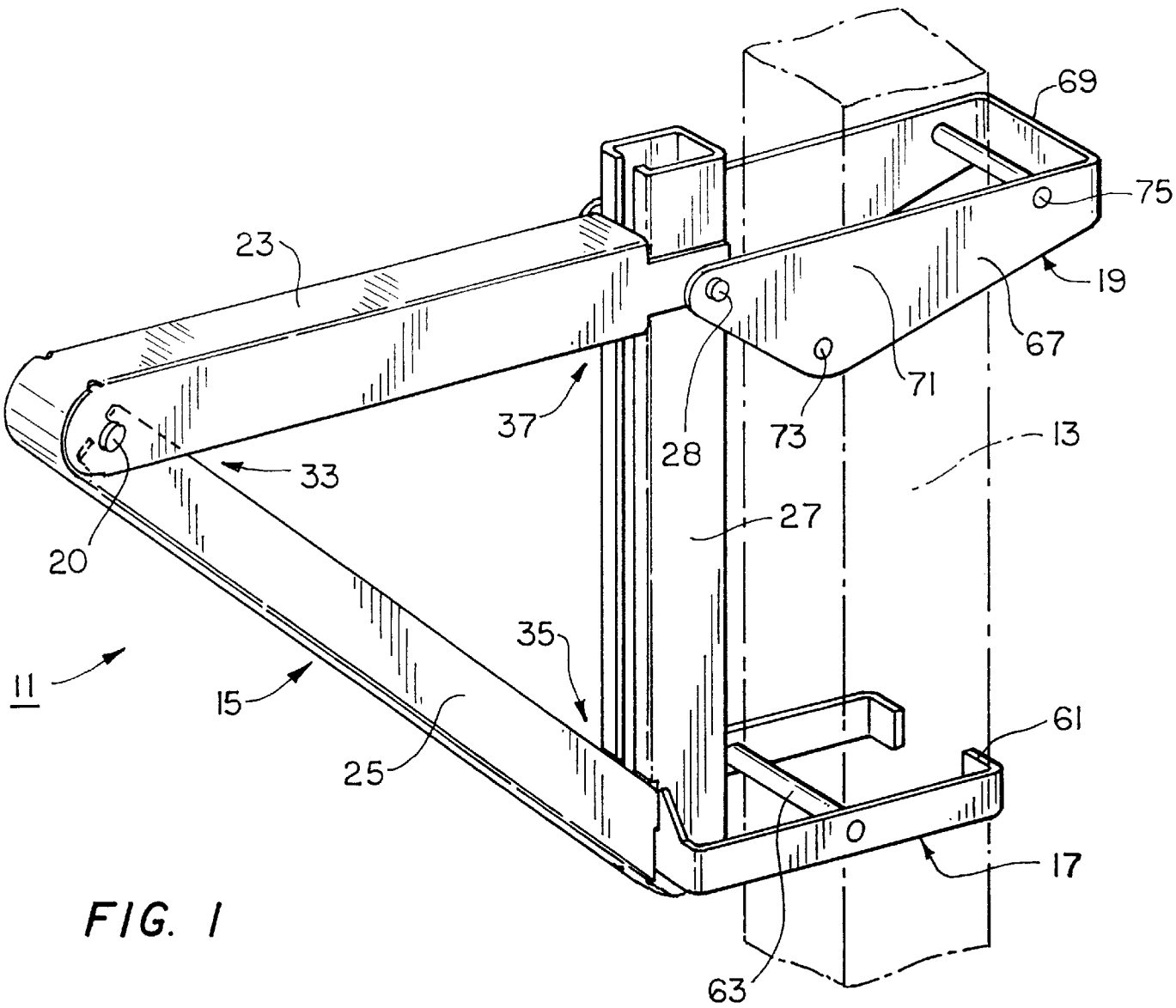
FIG. 1 is a perspective view of a first embodiment of a bracket assembly constructed according to the teachings of the present invention, the bracket assembly being shown mounted on an upright.

Referring now to FIG. 1, there is shown a perspective view of a bracket assembly constructed according to the teachings of the present invention, the bracket assembly being represented generally by reference numeral 11. Bracket assembly 11 is shown mounted on an upright 13 shown in phantom, upright 13 representing an object such as a beam or pole.

Bracket assembly 11 comprises an angle bracket 15, a lower bracket arm 17, an upper bracket arm 19 and a grooved anchoring bolt 20. Bracket arms 17 and 19 cooperate to mount angle bracket 15 onto upright 13. In this manner, a pair of bracket assemblies 11 can be used to create a scaffold. Specifically, with each of the pair of bracket assemblies mounted onto an associated upright, a scaffold is created by placing a plank across each angle bracket of the pair of bracket assemblies. It should be noted that, in addition to other useful purposes, such as attaching a putlog or platform stop, anchoring bolt 20 can serve as a means for attaching a platform supporting extension (not shown) to the horizontal leg of angle bracket 15, the platform supporting extension serving to increase the overall size of the surface on which a plank can be placed to create a scaffold.

Figure 2:
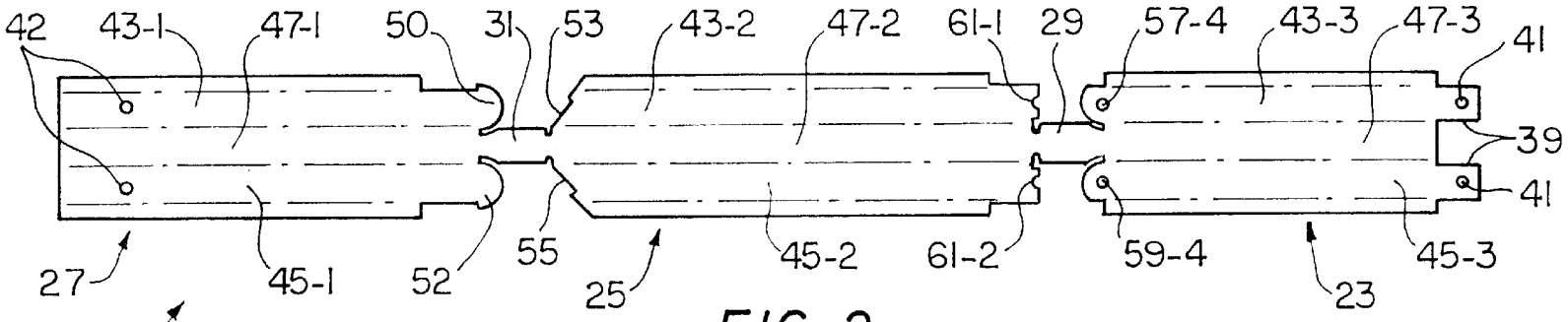
FIG. 2 is a top plan view of the metal blank of the angle bracket shown in FIG. 1.
Figure 3:
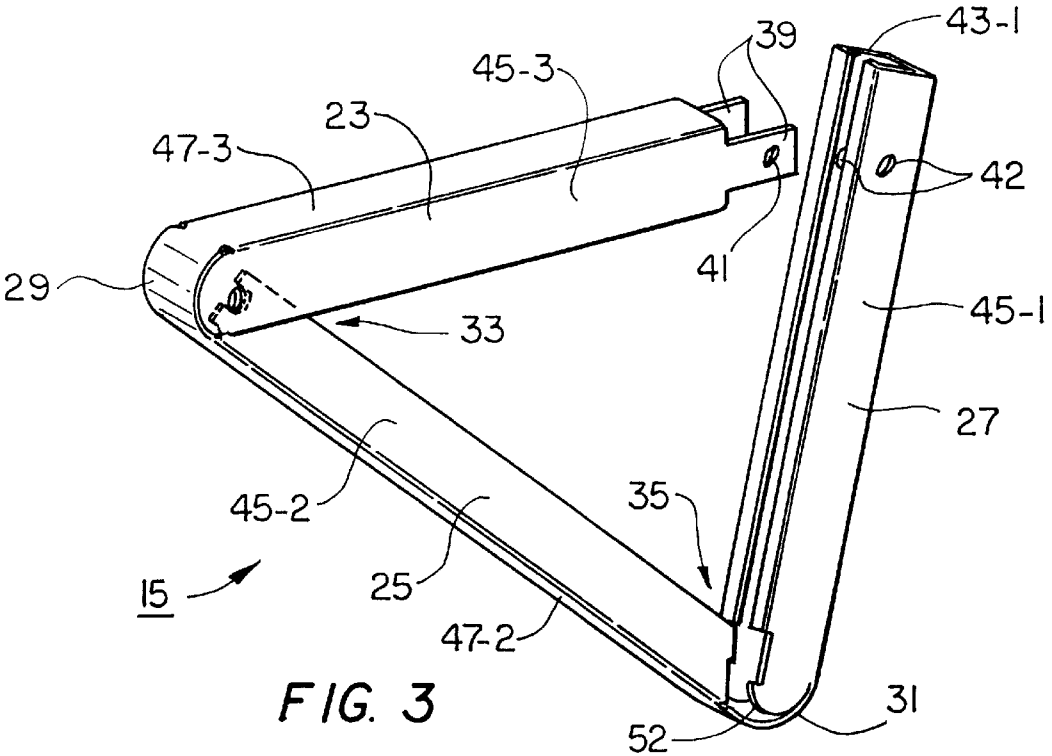
FIG. 3 is a perspective view of the metal blank shown in FIG. 2, the metal blank being shown partially folded into its final form.

Referring to FIG. 2, there is shown a top plan view of a metal blank 21. Metal blank 21 is shaped and bent in a series of steps, as shown in FIG. 3, so as to define angle bracket 15. Angle bracket 15 is a substantially triangular bracket comprising a horizontal leg 23, a diagonal leg 25 and a vertical leg 27. Horizontal leg 23 and diagonal leg 25 are contiguous and connect at a first bendable section 29. Diagonal leg 25 and vertical leg 27 are contiguous and connect at a second bendable section 31. Metal blank 21 is shaped and bent so that horizontal leg 23 and vertical leg 27 interconnect to form angle bracket 15, angle bracket 15 having a first acute corner 33, a second acute corner 35 and a square corner 37.

Metal blank 21 includes a pair of tabs 39, each tab 39 having a hole 41 formed therein. Holes 41 align with a pair of holes 42 formed in vertical leg 27 as metal blank 21 is shaped and bent into its load-bearing shape to form angle bracket 13. Tabs 39 are sized and shaped to pass along the outer surface of a pair of upstanding walls (to be described in detail below) on vertical leg 27 so that a bolt 28 in upper bracket arm 19 may be passed through holes 41 and 42, thereby ensuring that angle bracket 15 maintains its triangular, load-bearing shape. It should be noted that bracket assembly 11 is not limited to tabs, holes and a bolt to establish the interconnection of legs 23 and 27. Alternatively, tabs 39, holes 41 and 42 and bolt 28 could be replaced by other types of interconnecting means.

Vertical leg 27 includes a pair of upstanding sidewalls 43-1 and 45-1 which extend normally from a base 47-1 to create a substantially U-shaped cross section. Similarly, diagonal leg 25 includes a pair of upstanding sidewalls 43-2 and 45-2 which extend normally from a base 47-2 to create a substantially U-shaped cross-section. Horizontal leg 23 also includes a pair of upstanding sidewalls 43-3 and 45-3 which extend normally from a base 47-3 to create a substantially U-shaped cross-section. Upstanding sidewalls 43 and 45 in legs 23, 25 and 27 all extend normally from base 47 inward towards the center of angle bracket 13. Upstanding sidewalls 43-2 and 45-2 of diagonal leg 25 and upstanding sidewalls 43-3 and 45-3 of horizontal leg 23 overlap. Similarly, upstanding sidewalls 43-1 and 45-1 of vertical leg 27 and upstanding sidewalls 43-3 and 45-3 of horizontal leg 23 overlap.

Figure 4:
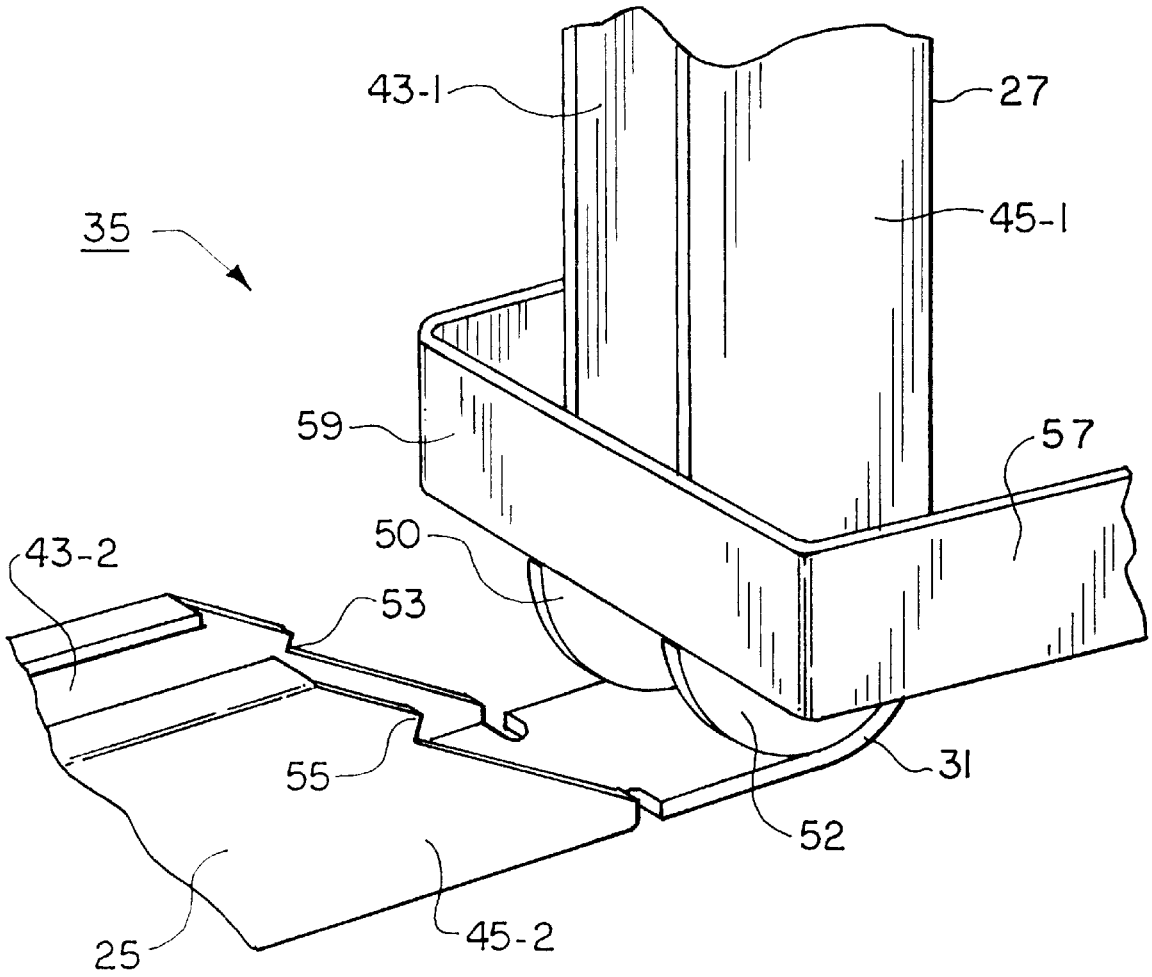
FIG. 4 is an enlarged perspective view, broken away in part, of the second acute corner of the bracket assembly of FIG. 1, the second acute corner being shown partially folded its final form with the lower bracket arm positioned between the vertical leg ad the diagonal leg.
Figure 5:
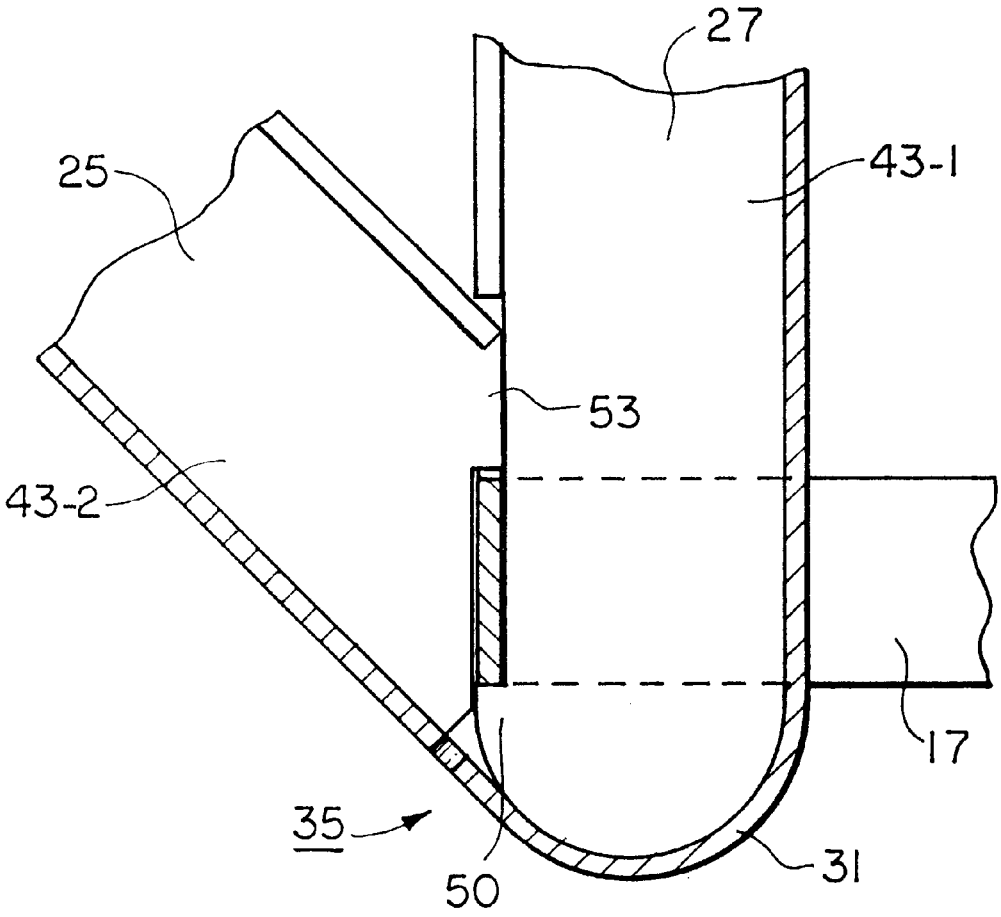
FIG. 5 is an enlarged side section view, broken away in part, of the second acute corner of the bracket assembly shown in FIG. 1, the second acute corner being shown positioned between the vertical leg and the diagonal leg.
Figure 6:
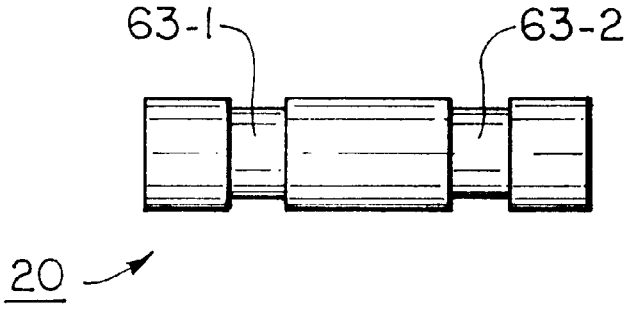
FIG. 6 is an enlarged front plan view of the grooved bolt shown in FIG. 1.
Figure 7:
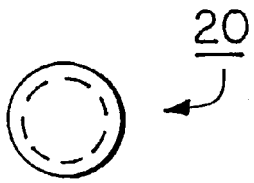
FIG. 7 is an end view of the bolt shown in FIG. 6.
Figure 8:
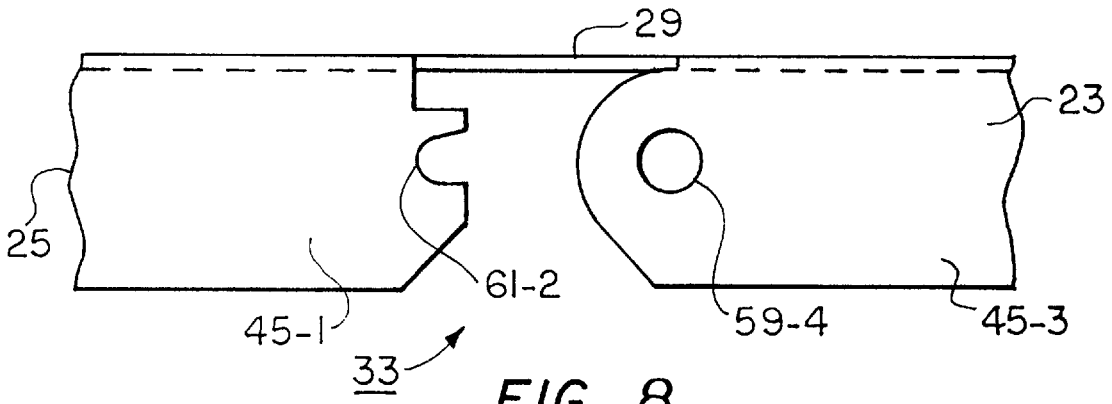
FIG. 8 is a side view, broken away in part, of the first acute corner of the angle bracket shown in FIG. 1, the first acute corner being shown partially bent along longitudinal lines into its final form.
Figure 9:
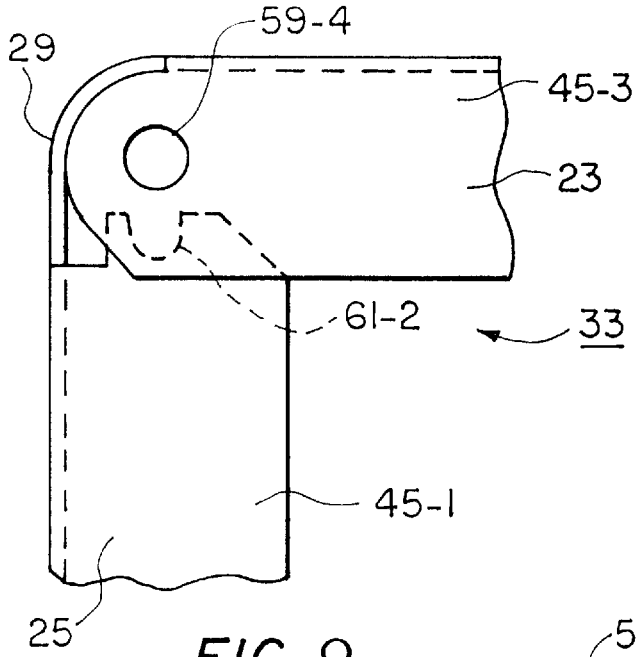
FIG. 9 is a side view, broken away in part, of the first acute corner of the angle bracket shown in FIG. 1, the first acute being shown partially folded into its final form.
Figure 10:
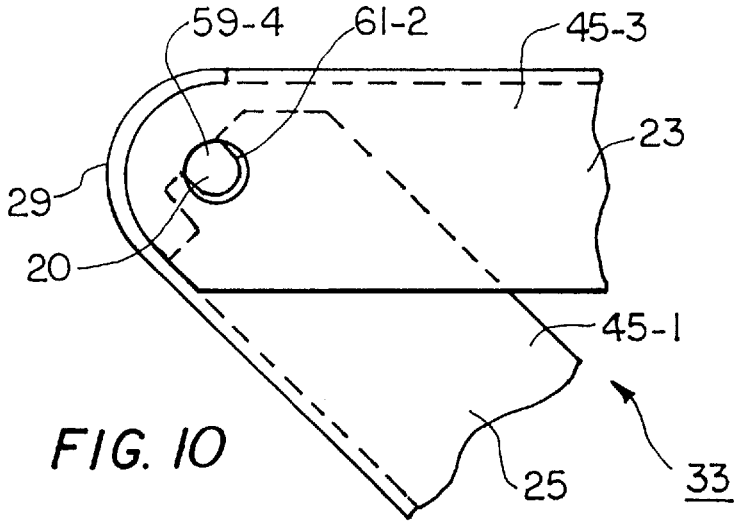
FIG. 10 is a side view, broken away in part, of the first acute corner of the bracket assembly shown in FIG. 1, the first acute corner being shown folded into its final form with the grooved bolt captured between the horizontal and diagonal legs.

Referring now to FIGS. 4 and 5, there are shown enlarged perspective and side views, respectively, of second acute corner 35 of bracket assembly 11. As can be seen, vertical leg 27 includes a first surface irregularity in the form of a pair of shoulders 50 and 52. Shoulders 50 and 52 are positioned on upstanding sidewalls 43-1 and 45-1, respectively, of vertical leg 27. In addition, diagonal leg 25 includes a first surface irregularity in the form of a pair of shoulders 53 and 55. Shoulders 53 and 55 are positioned on upstanding sidewalls 43-2 and 45-2, respectively, of diagonal leg 25. Shoulders 50 and 52 and shoulders 53 and 55 are disposed on opposing sides of and in close proximity to second bendable section 31.

Lower bracket arm 17 comprises a generally U-shaped band 57 having a closed end 59 and a partially open end 61. Lower bracket arm 17 further includes a separator 63. Partially open end 61 and separator 63 cooperate to engage opposing sides of upright 13.

As shown in FIG. 5, closed end 59 of lower bracket arm 17 is coupled to angle bracket 15 at second acute corner 35, closed end 59 being positioned within vertical leg 27 and diagonal leg 25. Closed end 59 is sized and shaped so as to rest on shoulders 50 and 52. As metal blank 21 is bent into its load bearing shape to form angle bracket 15, shoulders 53 and 55 lockingly engage from above closed end 59 of lower bracket arm 17, thereby securing lower bracket arm 17 in place. As can be appreciated, leg 25 is limited in its movement downward because shoulders 53 and 55 directly contact lower bracket arm 17. In turn, lower bracket arm 17 is restrained from moving downward by shoulders 50 and 52 on vertical leg 27. As such, a load on horizontal leg 23 will not unbend second bendable section 31. Rather, a load on horizontal leg 23 is shunted around second bendable section 31, through lower bracket arm 17 and directly to vertical leg 27.

Referring now to FIGS. 6 through 10, bolt 20 serves a similar function in shunting a vertical load on horizontal leg 23 for first acute corner 33 as lower bracket arm 17 served for second acute corner 35. Specifically, first surface irregularities in the form of holes 57-4 and 59-4 are provided in horizontal side walls 43-3 and 45-3, respectively, of horizontal leg 23, through which grooved bolt 20 may be inserted. Second surface irregularities in the form of semi-circular notches 61-1 and 61-2 are provided in the diagonal side walls 43-2 and 45-2, respectively, of diagonal leg 25. Notches 61-1 and 61-2 are dimensioned to engage the grooves 63-1 and 63-2 of bolt 20 when first bendable section 29 between horizontal leg 23 and diagonal leg 25 has been formed into its load-bearing shape. As can be appreciated, a vertical load on horizontal arm 23 is prevented from unbending first bendable section 29 because the downward force exerted on first bendable section 19 is transferred to bolt 20, holes 57-4 and 59-4 in horizontal arm 23 and then to semi-circular notches 61-1 and 61-2 in diagonal sidewalls 43-2 and 45-2 of diagonal leg 25.

Upper bracket arm 19 is a conventional load activated lock which supports angle bracket 15 on upright 13, upper bracket arm being any type of load activated lock which is well known in the art, such as U.S. Pat. No. 2,342,427 to Riblet. Upper bracket arm 19 comprises a generally U-shaped member 67 having a closed end 69 and an open end 71. Upper bracket arm 19 further includes an inner jaw 73 and an outer jaw 75 which engage opposing sides of upright 13. Inner jaw 73 and outer jaw 75 of upper bracket arm 19 and partially open end 61 and separator 63 of lower bracket arm 17 together cooperate to enable bracket assembly 11 to be mounted onto upright 13. Upper bracket arm 19 further comprises bolt 28 which is coupled to angle bracket 15 at square corner 37. Bolt 28 serves as a fulcrum point about which upper bracket arm 19 is free to rotate.

FIGS. 11 through 16, disclose of three modifications of first acute corner 33, the three modifications being identified generally as first acute corners 133, 233 and 333, respectively. The three modifications illustrate the fact that there are many equivalent ways in which surface irregularities in either or both diagonal leg 15 and horizontal leg 23 may capture a second member, such as a bolt, while first bendable section 29 is being formed into its load-bearing shape, the second member which may or may not serve to shunt some or all of the force applied on first bendable section when a vertical load is applied to horizontal leg 23.

Figure 11:
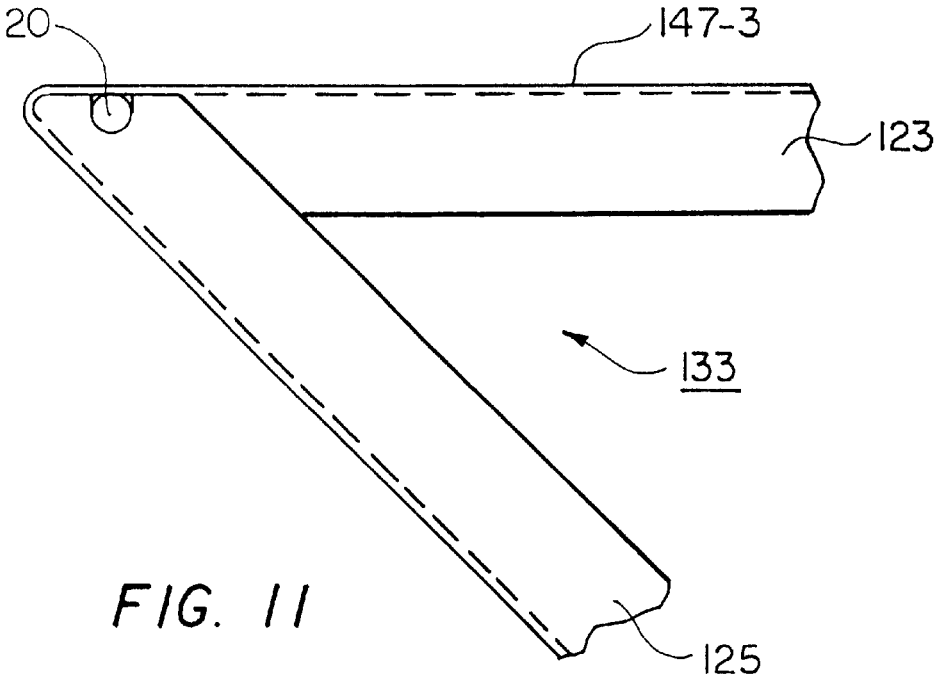
FIG. 11 is a side view, broken away in part, of a first modification of the first acute corner of the angle bracket shown in FIG. 1, the first acute corner being shown folded into its final form with the grooved bolt captured between the horizontal and diagonal legs.
Figure 12:
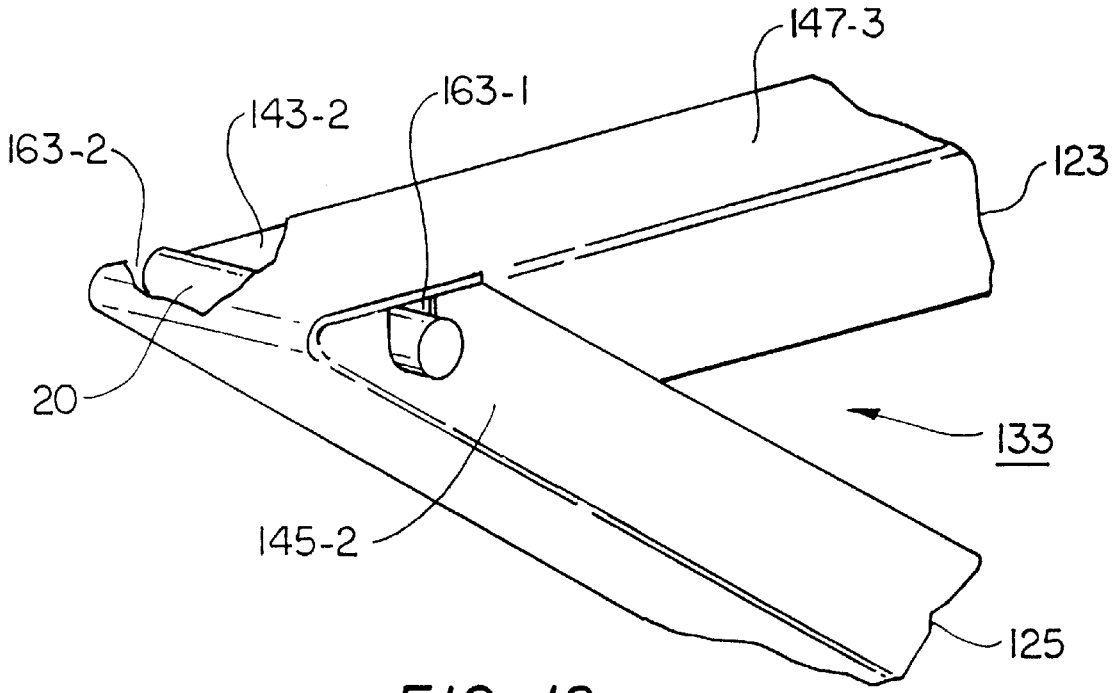
FIG. 12 is a perspective section view, broken away in part, of the first acute corner shown in FIG. 11.

Referring now to FIGS. 11 and 12, in one modification, first acute corner 133 is shown with bolt 20 captured between a pair of grooves 163-1 and 163-2 formed in diagonal side walls 145-2 and 143-2, respectively, of diagonal leg 125 and the lower surface of horizontal base 147-3 of horizontal leg 123. It should be noted that grooves 163-1 and 163-2 do not engage horizontal base 147-3 but rather grooves 163 serve to support bolt 20 in place.

Figure 13:
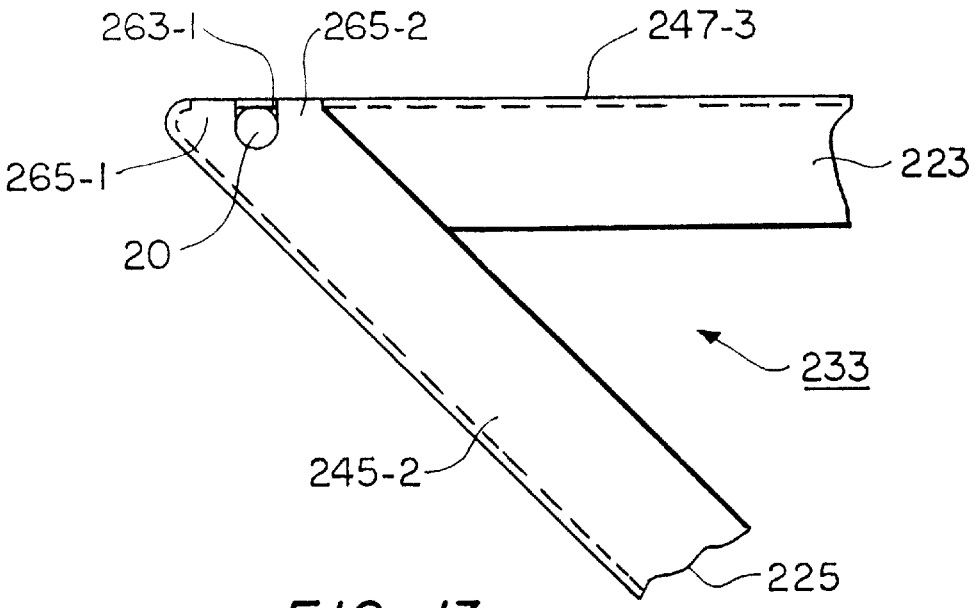
FIG. 13 is a side view, broken away in part, of a second modification of the first acute corner of the angle bracket shown in FIG. 1, the first acute corner being shown folded into its final form with the grooved bolt captured between the horizontal and diagonal legs and with tabs in the diagonal leg interlocking with slots in the horizontal leg.
Figure 14:
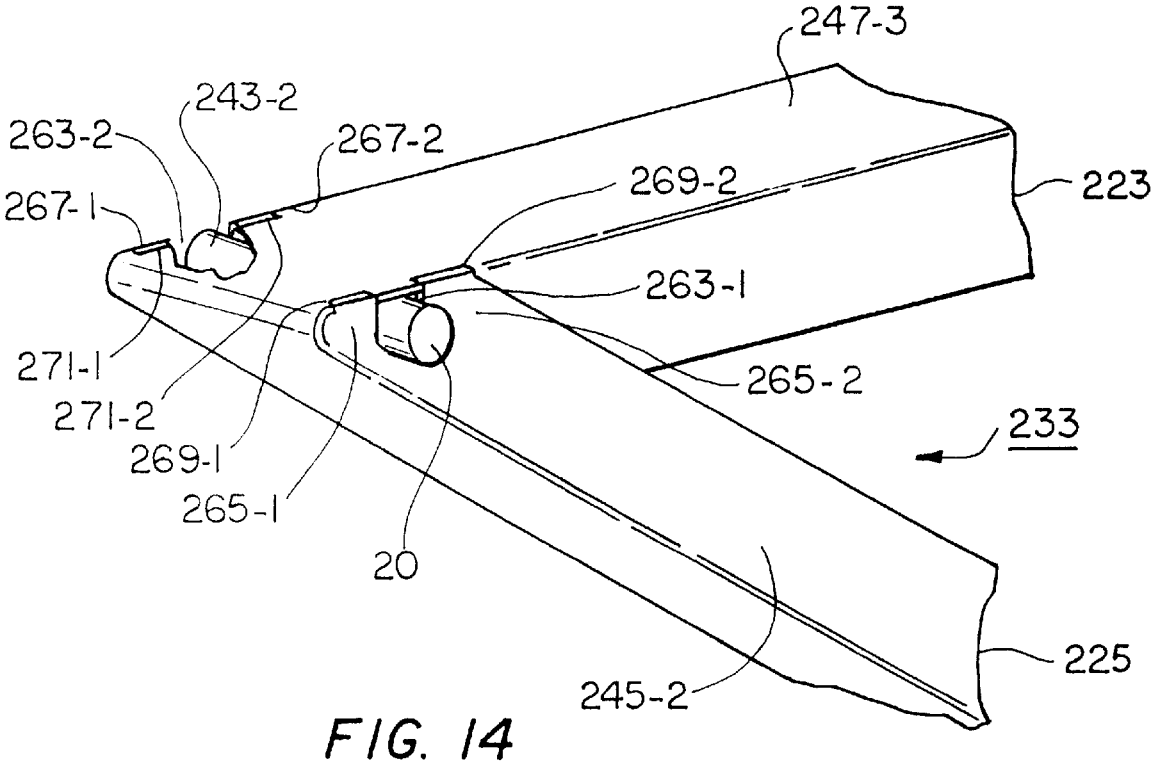
FIG. 14 is a perspective section view, broken away in part, of the first acute corner shown in FIG. 13.

Referring now to FIGS. 13 and 14, in another modification, first acute corner 233 is shown with bolt 20 captured between a pair of grooves 263-1 and 263-2 formed in diagonal side walls 245-2 and 243-2, respectively, of diagonal leg 225 and the lower surface of horizontal base 247-3 of horizontal leg 223. Diagonal side wall 245-2 further includes a pair of tabs 265-1 and 265-2 and diagonal sidewall 243-2 further includes a pair of tabs 267-1 and 267-2. Tabs 265-1, 265-2, 267-1 and 267-2 engage a plurality of notches 269-1, 269-2, 271-1 and 271-2, respectively, formed in base 247-3 of horizontal leg 223 and, without bolt 20, prevent deformation of first bendable section 229 which could result from the introduction of a heavy vertical load on horizontal leg 223.

Figure 15:
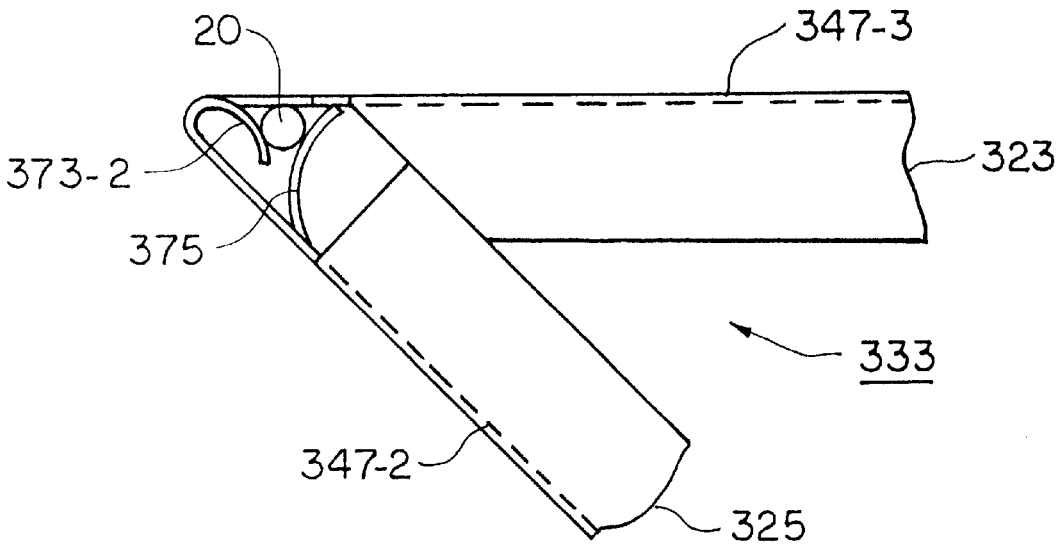
FIG. 15 is a side view, broken away in part, of a third modification of the first acute corner of the angle bracket shown in FIG. 1, the first acute corner being shown folded into its final form with the grooved bolt captured between the horizontal and diagonal leg.
Figure 16:
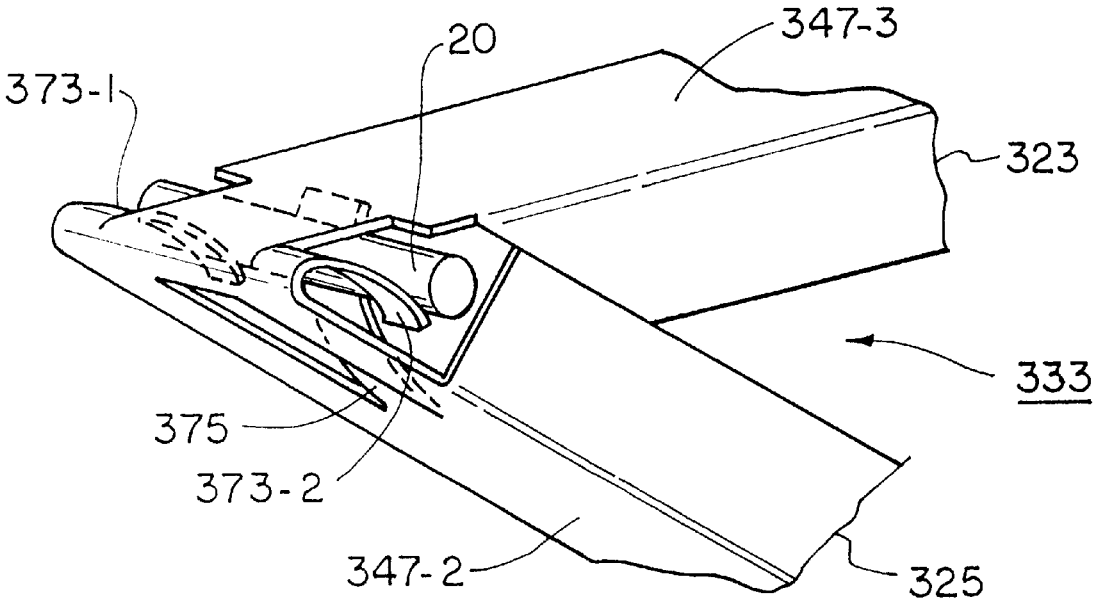
FIG. 16 is a perspective view, broken away in part, of the first acute corner shown in FIG. 15.

Referring now to FIGS. 15 and 16, in another modification, first acute corner 333 is shown with bolt 20 captured between a pair of curved tabs 373-1 and 373-2 formed in horizontal base 347-3 of horizontal leg 323 and a single curved tab 375 formed in diagonal base 347-2 of diagonal leg 325. As can be appreciated, forces that would unbend first bendable section 329 are shunted instead from horizontal leg 323 directly to diagonal leg 325, through bolt 20.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A bracket assembly comprising:

(a) an angle bracket formed from a single-piece metal blank, shaped and bent to define, in its load-bearing form, a substantially triangular bracket having vertical, diagonal and horizontal legs, the horizontal and diagonal legs being connected by a first bendable section to define a first acute corner, the diagonal and vertical legs being connected by a second bendable section to define a second acute corner and the vertical and horizontal legs being interconnected to define a third corner; and (b) a first member coupled to said angle bracket one of said acute corners, said first member being captured by at least one surface irregularity at one of said acute corners when the angle bracket is formed into its load-bearing shape.

2. The bracket assembly as claimed in claim 1 wherein said first member is captured by the at least one surface irregularity to shunt around said acute corner forces introduced by a heavy load placed on the horizontal leg of said angle bracket.

3. The bracket assembly as claimed in claim 1 wherein said first member is a lower bracket arm captured at the second acute corner between the vertical and diagonal legs of said angle bracket.

4. The bracket assembly as claimed in claim 3 wherein said lower bracket arm is captured by the at least one surface irregularity at the first acute corner to shunt around the first bendable section forces introduced by a heavy load placed on the horizontal leg of said angle bracket.

5. The bracket assembly as claimed in claim 4 wherein the at least one surface irregularity at the first acute corner is in the form of a pair of notches.

6. The bracket assembly as claimed in claim 1 wherein said first member is a bolt captured at the first acute corner by the horizontal and diagonal legs of said angle bracket.

7. The bracket assembly as claimed in claim 6 wherein said bolt is captured by the at least one surface irregularity at the second acute corner to shunt around the second bendable section forces introduced by a heavy load placed on the horizontal leg of said angle bracket.

8. The bracket assembly as claimed in claim 7 wherein the at least one surface irregularity at the first acute corner includes a semicircular notch.

9. A one-piece metal blank for forming an angle bracket, said metal blank comprising:

(a) a first base, a second base, a third base, a first elongated bendable section connecting said first base to said second base, a second elongated bendable section connecting said second base to said third base, a first pair of outer sidewalls connected to said first base, a second pair of outer sidewalls connected to said second base and a third pair of outer sidewalls connected to said third base, wherein said first base, said second base, said third base, said first pair of outer sidewalls, said second pair of outer sidewalls, said third pair of outer sidewalls, said first elongated bendable section and said second elongated bendable section can be shaped and bent so as to define in its load-bearing form a substantially triangular angle bracket having horizontal, diagonal and vertical legs, the horizontal leg comprising the first base and the first pair of outer sidewalls, the diagonal leg comprising the second base and the second pair of outer sidewalls, and the vertical leg comprising the third base and the third pair of outer sidewalls, said first base being connected with said second base only through the first elongated bendable section and said third base being connected with said second base only through the second elongated bendable section.

10. The metal blank of claim 8 wherein the first elongated bendable section has a length from said first base to said second base comparable to the width of one of said first and second pairs of outer sidewalls.

11. The metal blank of claim 8 wherein the first elongated bendable section has a length from said first base to said second base comparable to the width of said second base.

12. The metal blank of claim 8 wherein the second elongated bendable section has a length from said third base to said second base comparable to the width of one of said outer sidewalls of said second and third pairs of outer sidewalls.

13. The metal blank of claim 8 wherein the horizontal leg has a first surface irregularity and the diagonal leg has a second surface irregularity, said first and second surface irregularities in said horizontal and diagonal legs, respectively, being sized and shaped so as to capture a member independent of said angle bracket as said blank is folded into said angle bracket.

14. The metal blank of claim 8 wherein the diagonal leg has a first surface irregularity and the vertical leg has a first surface irregularity, said first surface irregularity in said diagonal leg and said first surface irregularity in said vertical leg being sized and shaped so as to capture a member independent of said angle bracket as said blank is folded into angle bracket.

15. The metal blank of claim 8 wherein one of the horizontal leg and the diagonal leg has a surface irregularity, said first surface irregularity being sized and shaped so as to capture a member independent of said angle bracket as said blank is folded into said angle bracket.

16. The metal blank of claim 8 wherein one of the diagonal leg and the vertical leg has a surface irregularity, said surface irregularity being sized and shaped so as to capture a member independent of said angle bracket as said blank is folded into said angle bracket.

17. The metal blank of claim 8 wherein the second elongated bendable section has a length from said first base to said second base comparable to the width of said second base.

18. A bracket assembly comprising:

(a) an angle bracket formed from a single-piece metal blank, shaped and bent to define, in its load-bearing form, together with a vertical supporting structure, a substantially triangular shape having, at least, a horizontal leg and a diagonal leg, the horizontal and diagonal legs being connected by a bendable section to define a first acute corner; and (b) a first member coupled to said angle bracket at said first acute corners, said first member being captured by at least one surface irregularity at said acute corner when the angle bracket is formed into its load-bearing shape.

19. The bracket assembly of claim 18 wherein said vertical supporting structure is a vertical leg which is connected to said diagonal leg by a second bendable section to define a second acute corner when the angle bracket is formed into its load bearing form, said horizontal and vertical legs being interconnected to define a third corner when the angle bracket is formed into its load bearing form.

20. A bracket assembly comprising:

(a) an angle bracket formed from a single-piece metal blank, shaped and bent to define, in its load-bearing form, a substantially triangular bracket having vertical, diagonal and horizontal legs, the horizontal and diagonal legs being connected by a first bendable section to define a first acute corner, the diagonal and vertical legs being connected by a second bendable section to define a second acute corner and the vertical and horizontal legs being interconnected to define a third corner, each of the vertical, diagonal and horizontal legs including a pair of upstanding sidewalls and a base which together form a substantially U-shaped cross-section; and (b) a first member coupled to said angle bracket, said first member being coupled to said angle bracket at one of said acute corners by at least one surface irregularity at said acute corner when the angle bracket is formed into its load-bearing shape.

21. The bracket assembly as claimed in claim 20 wherein the pair of upstanding walls of each leg extend normally from its associated base.

22. The bracket assembly as claimed in claim 21 wherein the pair of upstanding sidewalls of each leg extend normally from its associated base in the direction towards an approximate center of said angle bracket.

23. A bracket assembly comprising:

(a) an angle bracket formed from a single-piece metal blank, shaped and bent to define, in its load-bearing form, a substantially triangular bracket having vertical, diagonal and horizontal legs, the horizontal and diagonal legs being connected by a first bendable section to define a first acute corner, the diagonal and vertical legs being connected by a second bendable section to define a second acute corner and the vertical and horizontal legs being interconnected to define a third corner; and (b) a bolt captured at the first acute corner by the horizontal and diagonal legs of said angle bracket, said bolt being captured at the first acute corner by a pair of semicircular notches formed on a pair of upstanding sidewalls on said diagonal leg at the second acute corner when said angle bracket is formed into its load-bearing shape to shunt around the second bendable section forces introduced by a heavy load placed on the horizontal leg of said angle bracket, said pair of notches being sized and shaped so as to capture said bolt.

24. The bracket assembly as claimed in claim 23 wherein said pair of semicircular notches capture the bolt at the second acute corner to shunt around the second bendable section forces introduced by the heavy load placed on the horizontal leg of said angle bracket.

25. A bracket assembly comprising:

(a) an angle bracket formed from a single-piece metal blank, shaped and bent to define, in its load-bearing form, a substantially triangular bracket having vertical, diagonal and horizontal legs, the horizontal and diagonal legs being connected by a first bendable section to define a first acute corner, the diagonal and vertical legs being connected by a second bendable section to define a second acute corner and the vertical and horizontal legs being interconnected to define a third corner, the vertical leg including a pair of upstanding sidewalls and a base which together form a substantially U-shaped cross-section; and (b) a lower bracket arm captured at the second acute corner between the vertical and diagonal legs of said angle bracket, said lower bracket arm being captured at the second acute corner by at least one surface irregularity when the angle bracket is formed into its load-bearing shape to shunt around the first bendable section forces introduced by a heavy load placed on the horizontal leg of said angle bracket, said at least one surface irregularity comprising a first pair of shoulders, one shoulder being formed on each upstanding sidewall of the vertical leg, said first pair of shoulders being sized and shaped so that said lower bracket arm is positionable therein.

26. The bracket assembly as claimed in claim 25 wherein the at least one surface irregularity at the first acute corner includes a second pair of pair of notches, one shoulder being formed on each upstanding sidewall of the diagonal leg, said second pair of shoulders being sized and shaped so as to capture said lower bracket arm.

27. The bracket assembly as claimed in claim 26 wherein said first and second pairs of shoulders capture said lower bracket arm at the second acute corner to shunt around the first bendable section forces introduced by a heavy load placed on the horizontal leg of said angle bracket.

28. A bracket assembly comprising:

(a) an angle bracket formed from a single-piece metal blank, shaped and bent to define, in its load-bearing form, a substantially triangular bracket having vertical, diagonal and horizontal legs, the horizontal and diagonal legs being connected by a first bendable section to define a first acute corner, the diagonal and vertical legs being connected by a second bendable section to define a second acute corner and the vertical and horizontal legs being interconnected to define a third corner, the horizontal leg including a pair of upstanding sidewalls and a base which together form a substantially U-shaped cross-section; and (b) a bolt captured at the first acute corner between the horizontal and diagonal legs of said angle bracket, said bolt being captured at the first acute corner by a pair of holes when the angle bracket is formed into its load-bearing shape to shunt around the second bendable section forces introduced by a heavy load placed on the horizontal leg of said angle bracket, one hole being formed on each upstanding sidewall of the horizontal leg, said pair of holes being sized and shaped so that the bolt is positionable therein.

* * * * *